United States Patent [19]

Aschauer

[11] Patent Number: 4,783,984

[45] Date of Patent: Nov. 15, 1988

[54] APPARATUS FOR FOLDING A SHEET METAL ELEMENT

[75] Inventor: Hans Aschauer, Eferding, Austria

[73] Assignee: Voest-Alpine Aktiengesellschaft, Linz, Austria

[21] Appl. No.: 410,617

[22] Filed: Aug. 23, 1982

[30] Foreign Application Priority Data

Oct. 9, 1981 [AT] Austria ..... 4329/81

[51] Int. Cl.[4] ..... B21D 5/04

[52] U.S. Cl. ..... 72/319

[58] Field of Search ..... 72/319-323, 72/306, 316, 293, 388, 312-315

[56] References Cited

U.S. PATENT DOCUMENTS

| | | | |
|---|---|---|---|
| 1,966,472 | 7/1934 | Way | 72/314 |
| 2,822,545 | 2/1958 | Eickhoff | 72/313 |
| 2,937,689 | 5/1960 | Peterson | 72/320 |
| 3,009,201 | 11/1961 | Hansen | 72/322 |
| 3,149,376 | 9/1964 | Lee | 72/306 |
| 3,914,974 | 10/1975 | De Vore | 72/319 |
| 3,994,152 | 11/1976 | Wolters | 72/315 |
| 4,185,487 | 1/1980 | Merideth | 72/315 |

FOREIGN PATENT DOCUMENTS

| | | | |
|---|---|---|---|
| 2542239 | 3/1977 | Fed. Rep. of Germany . | |
| 2844509 | 4/1979 | Fed. Rep. of Germany . | |
| 348265 | 8/1972 | U.S.S.R. | 72/388 |

*Primary Examiner*—Daniel C. Crane

*Attorney, Agent, or Firm*—Kurt Kelman

[57] ABSTRACT

Apparatus for folding a sheet metal element comprises a frame, two carriers carried by the frame, and two gripping platens which are secured to respective ones of the carriers and at least one of which is movable in unison with the associated carrier transversely to the sheet metal element gripped between said platens. At least one bending tool is provided, which is movable generally parallel to the sheet metal element and is also movable transversely to the sheet metal element and is operatively connected to drive means for moving the tool in said two directions. The tool cooperates with one of the gripping platens, which constitutes a backing tool. In order to prevent a deflection of the gripping platens during the folding operation, those drive means which serve to move the bending tool generally parallel to the sheet metal element is supported by the carrier which carries that gripping platen which serves as a backing tool.

3 Claims, 6 Drawing Sheets

APPARATUS FOR FOLDING A SHEET METAL ELEMENT

Figure 1:
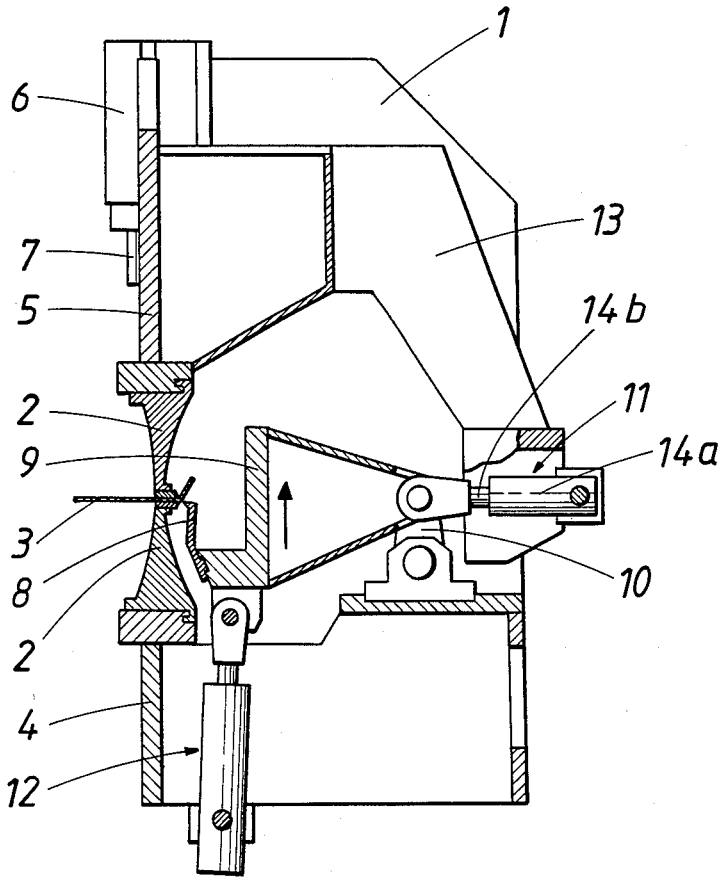

This invention relates to apparatus for folding a sheet metal element, comprising a frame, two carriers carried by the frame, and two gripping platens, which are secured to respective ones of the carriers and at least one of which is movable in unison with the associated carrier transversely to the plane of the sheet metal element gripped between the gripping platens. A bending tool is provided, which is mounted to be movable generally parallel to the plane of the sheet metal element gripped by the gripping platens and transversely to said plane and is operatively connected to respective drive means for moving the bending tool in said two directions. The bending tool cooperates with one of the gripping platens, which constitutes a backing tool.

In known apparatus of that kind the bending tools are mounted in the frame and the drive means for moving the bending tools are also supported in the frame. As a result, the gripping platens, which are frictionally interconnected by the workpiece during the bending operation, are subjected to bending stresses during the bending operation particularly by the drive means for moving the bending tool generally parallel to the plane of the gripped sheet metal element. Because these drive means are supported by the frame, that bending stress will force the gripping platens away from the frame so that the gripping platen which is movable transversely to the plane of the gripped sheet metal element will be canted in its tract provided in the frame. As a deflection of the gripping platens should be avoided as far as possible, so that a bending through a constant angle will be ensured throughout the length of the bending edge, it is desired to provide sufficiently rigid structures, which are expensive. But even such rigid structures cannot prevent a yielding of the gripping platens under a high bending stress.

It is an object of the invention to avoid these disadvantages and to provide apparatus which is of the kind described first hereinbefore and which has a simple structure that is light in weight and nevertheless prevents to a large extent an undesired deflection of the gripping platens by the bending forces exerted during the bending operation.

This object is accomplished according to the invention in that the drive means for moving the bending tool generally parallel to the plane of the gripped sheet metal element are supported by the carrier which carries the gripping platen which constitutes a backing tool.

Because that gripping platen which is formed with the bending edge and serves as a backing tool cooperating with the bending tool is subjected to a particularly high load by the drive means for moving the bending tool generally parallel to the plane of the gripped sheet metal element, the fact that said drive means are supported by the carrier which carries the gripping platen serving as a backing tool virtually results in a short circuit of forces between the gripping platen, the bending tool, the drive means for moving the bending tool generally parallel to the plane of the gripped sheet metal element, and the carrier which carries said gripping platen whereas other parts of the structure, particularly the other gripping platen, are relieved from said forces. This affords the advantage that, e.g., the gripping platen which is movable transversely to the plane of the gripped sheet metal element, cannot be canted in its track in the frame because the gripping platens will not be forced away from the frame. Besides, as the drive means for moving the bending tool generally parallel to the plane of the gripped sheet metal element are supported by the carrier which carries the gripping platen serving as a backing tool, said gripping platen, on the one hand, and the means for supporting the drive means for moving the bending tool, on the other hand, can be bent apart by a sufficiently strong bending force. As the gripping platen is held in position by the frame, the inevitable deformation has the result that the support for the drive means for moving the bending tool is bent away from the frame. This will ensure that the bending edge, which is formed by the gripping platen extends as desired. The connection between the gripping platen and the carrier which carries the gripping platen, on the one hand, and the frame, on the other hand, remains substantially free from load because the forces exerted by the drive means are not applied to the frame. Because the measures adopted by the invention prevent a deflection of the gripping platen serving as a backing tool during the bending operation, the other gripping platen will also remain free from substantial bending stresses because the gripping platen serving as a backing tool will transmit only pressure forces acting transversely to the plane of the gripped sheet metal element.

A particularly simple design will be obtained if the drive means for moving the bending tool generally parallel to the plane of the gripped sheet metal element consists of at least two actuators, which are pivoted to angled or curved brackets carried by the carrier. Because the actuators are spaced apart along the bending tool, the load applied to the bending tool can be more evenly distributed over the length of the bending tool so that the gripping platen serving as a backing tool can also be more uniformly loaded. By the angled or curved brackets by which the actuators are connected to the carrier, the forces to be taken up are properly introduced into the carrier. Nevertheless, unequal bending forces may be applied to the gripping platen at points spaced apart along the platen. This can be allowed for in that the actuating forces applied by the actuators are adjustable. If the actuators forces exerted by the actuators are selected in dependence on the load applied to the gripping platen, the latter may be maintained in a straight condition even under strong bending forces without a need for a provision of the gripping platen with separate means for compensating of any deformation of the gripping platen.

In bending apparatus comprising only one bending tool, the bending around the gripping platen which is movable transversely to the plane of the gripped sheet metal element requires that the drive means for moving the bending tool generally parallel to the plane of the gripped sheet metal element must be supported against the carrier which carries the adjustable gripping platen. If a bending tool of such apparatus is to be used for bending the sheet metal element around the other gripping platen, which is fixed in the frame, the fact that the drive means for moving the bending tool generally parallel to the plane of the gripped sheet metal element is supported by the carrier which carries the adjustable gripping platen would be highly undesirable. In order to permit nevertheless the use of the bending tool for bending the sheet metal element in the opposite direction, an additional feature of the invention resides in that the angled or curved brackets which are carried by the carrier and support the drive means for moving the bending tool generally parallel to the plane of the gripped sheet metal element are adapted to be positively connected to the carrier which carries the other gripping platen. Owing to that positive connection the other gripping platen may be included in analogous short circuit of forces which short circuit includes the bending tool, the drive means for moving the bending tool and the carrier which carries the other gripping platen then serving as a backing tool. Such a positive connection can be established in a very simple manner with the aid of slidable keys, provided that the positive connection is required mainly in the direction of action of the drive means for moving the bending tool generally parallel to the plane of the gripped sheet metal element because different conditions are obtained regarding the drive means for moving the bending tool transversely to the plane of the gripped sheet metal element.

Figure 2:
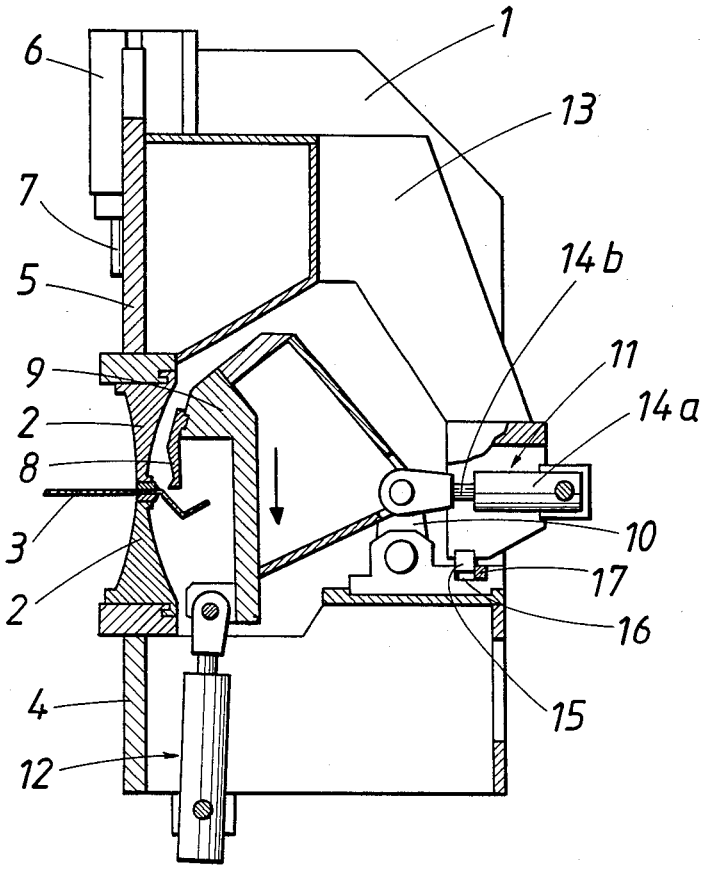
Figure 3:
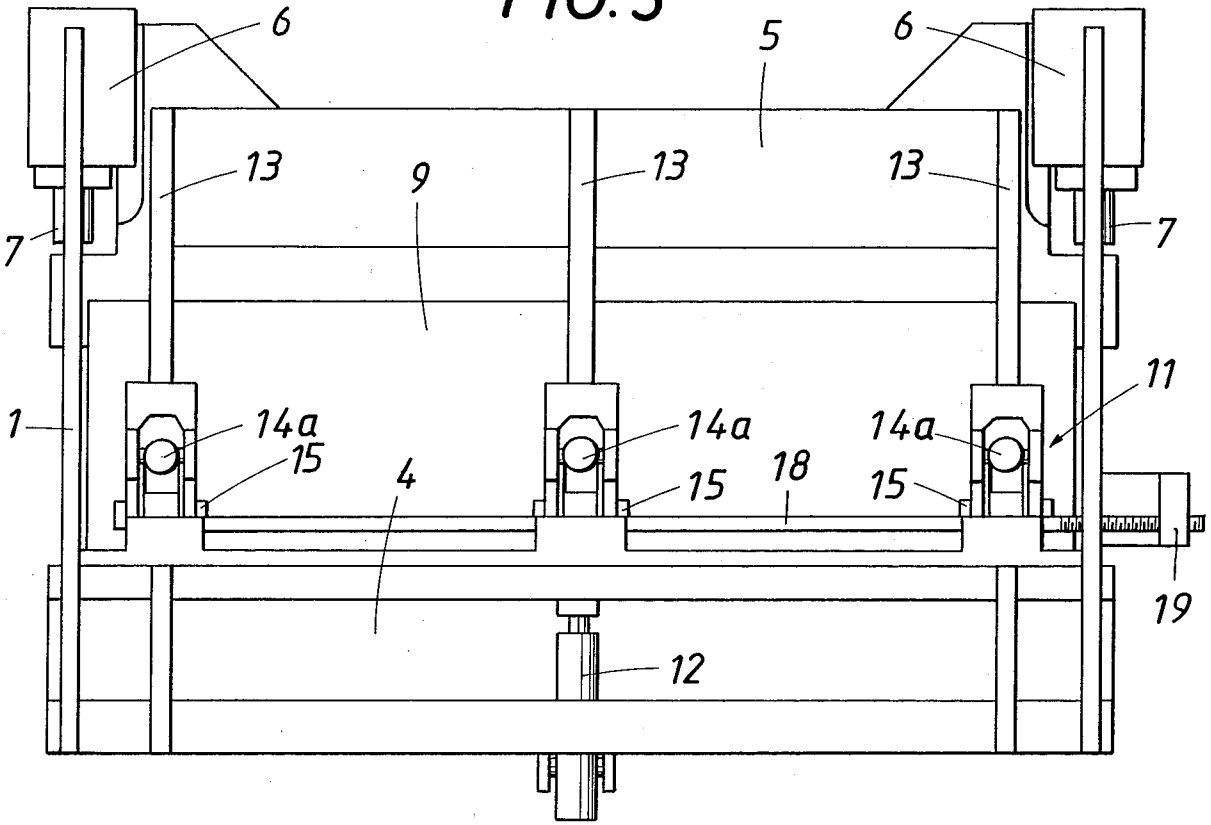
Figure 4:
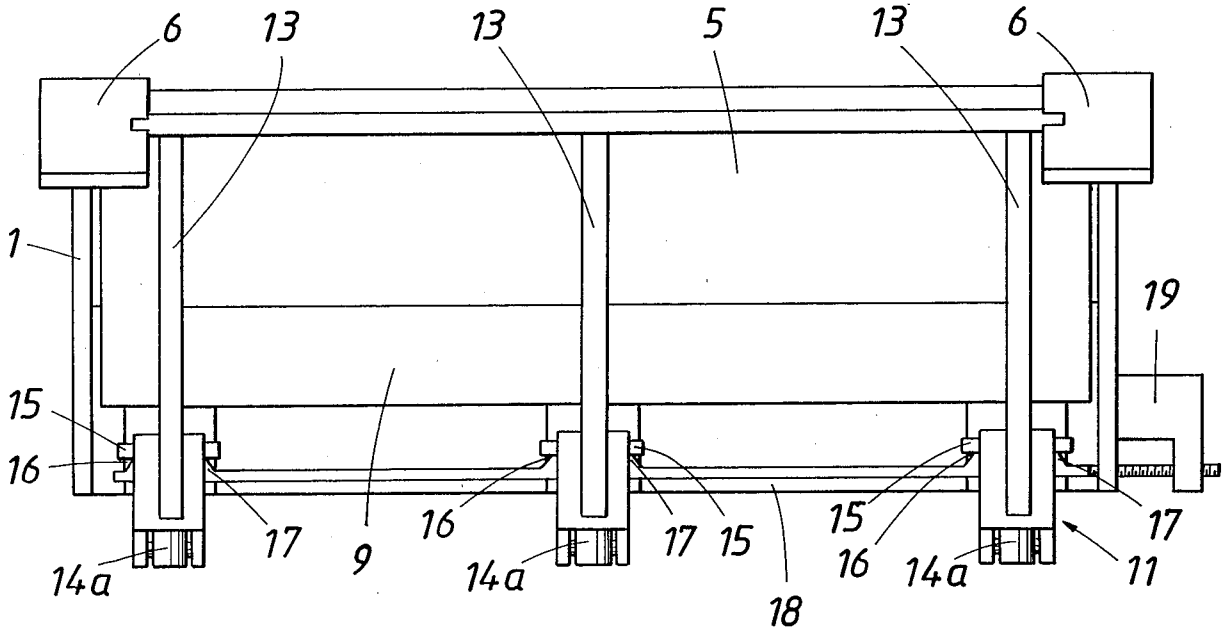
Figure 5:
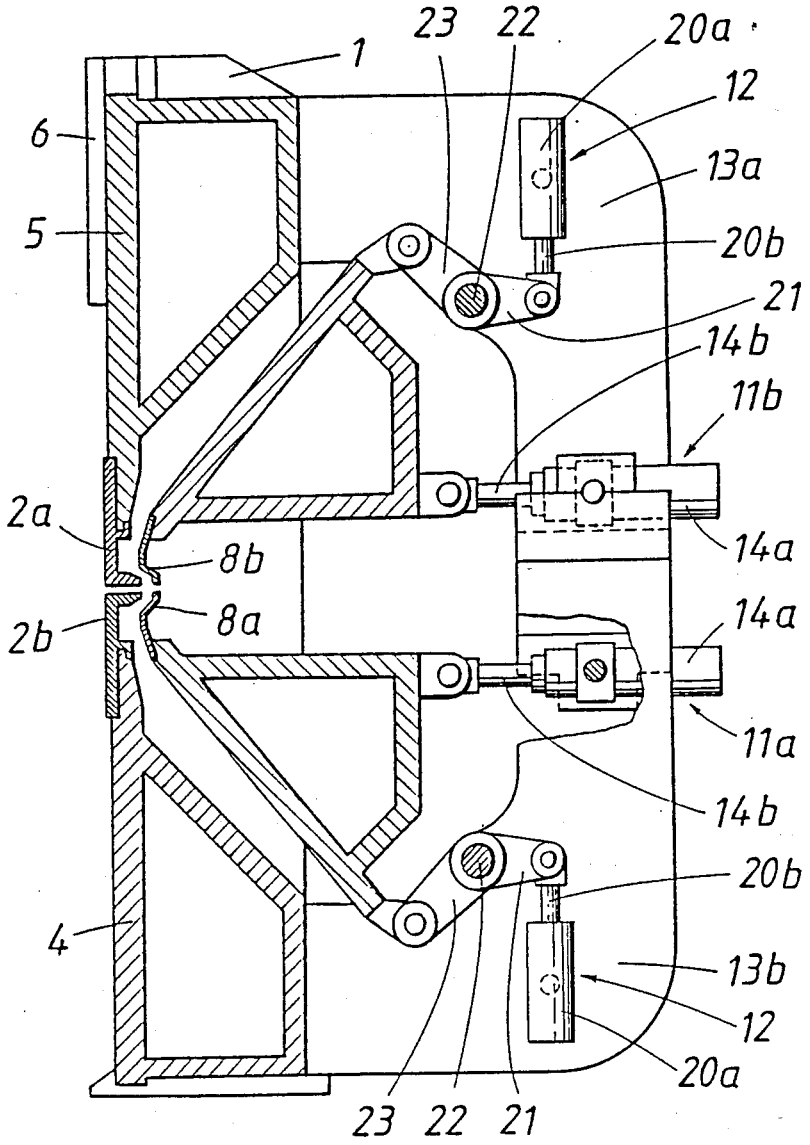
Figure 6:
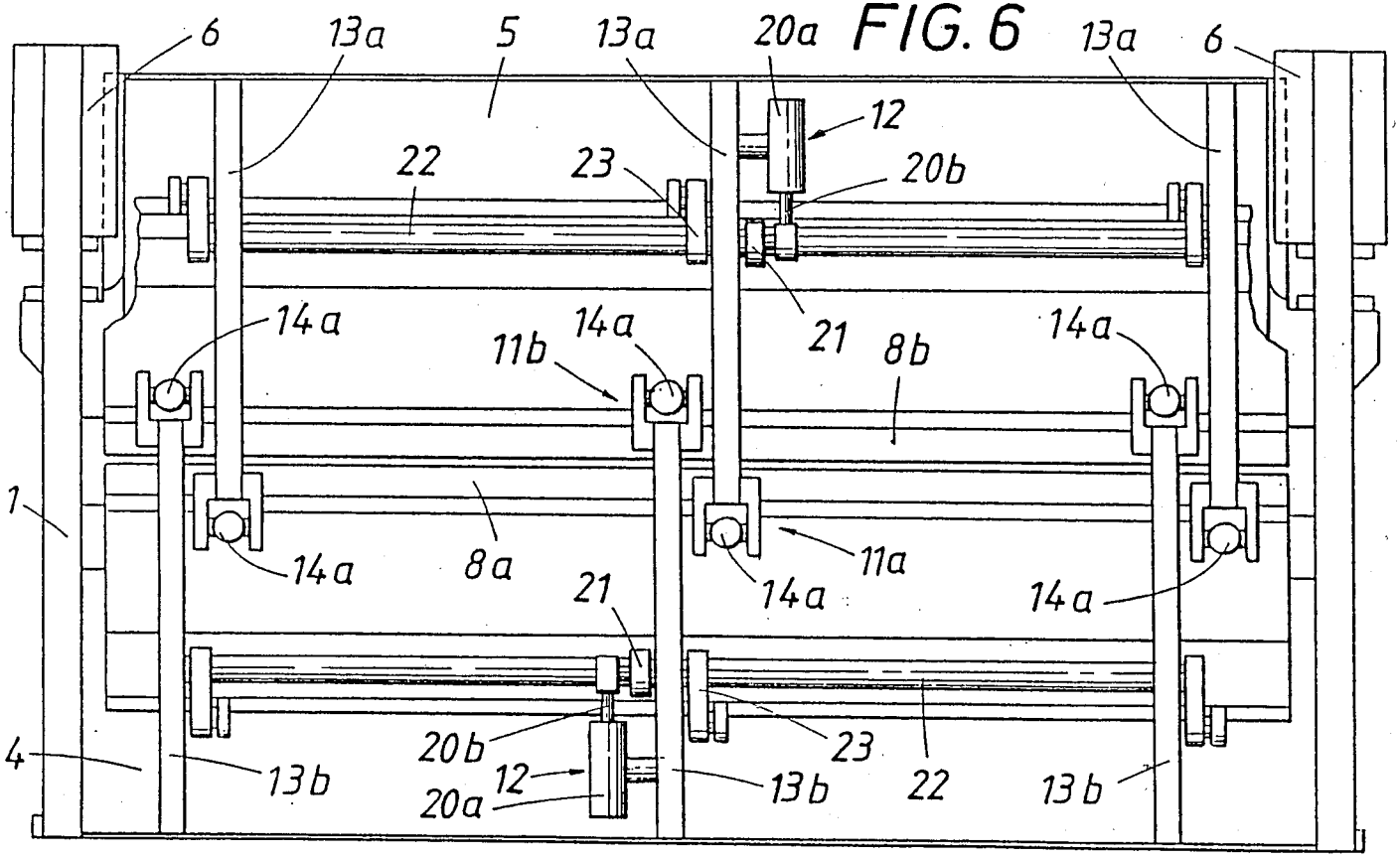

The invention is illustrated by way of example in the accompanying drawings, in which FIG. 1 is a simplified transverse sectional view showing apparatus according to the invention for folding a sheet metal element, FIG. 2 is a view that is similar to FIG. 1 and shows a modification of FIG. 1, FIG. 3 is a rear elevation showing the apparatus of FIG. 2, FIG. 4 is a top plan view showing the apparatus of FIG. 2, FIG. 5 is a simplified transverse sectional view showing apparatus comprising two bending tools for folding a sheet metal element and FIG. 6 is a rear elevation showing the apparatus of FIG. 5.

The illustrated apparatus for folding a flat sheet metal element comprise a frame 1, in which two gripping platens 2 are mounted, which serve to grip a generally flat sheet metal element 3. The lower gripping platen 2 is carried by a carrier 4 and by means of said carrier is immovably mounted in the frame. The upper gripping platen 2 is secured to a box-section carrier 5, which is guided at both ends in vertical tracks 6 provided in the frame 1 and can be raised and lowered by means of a pair of hydraulic cylinders 7.

The apparatus shown in FIGS. 1 to 4 comprises a bending tool 8, which serves to bend the sheet metal element 3 and is mounted on a tool carrier 9, which is pivoted to pivoted arms 10 so that the bending tool 8 can be moved transversely and generally parallel to the plane of the gripped sheet metal element. For this purpose, two separate drive means 11 and 12 are connected to the tool carrier 9, which carries the bending tool 8. The drive means 12 are operable to move the bending tool 8 transversely to the plane of the gripped sheet metal element. The drive means 11 are operable to move the bending tool 8 generally parallel to the plane of the gripped sheet metal element. The two means 11 and 12 are adapted to cooperate in such a manner that the bending tool 8 is moved around the bending edge of the gripping platen 2, which serves as a backing tool. That operation will result in particularly desirable bending conditions.

By the drive means 11 for moving the bending tool 8 generally parallel to the plane of the gripped sheet metal element, the gripping platen 2 serving as a backing tool is subjected to a strong bending load and may be deflected under that load. As a result, the bending edge will no longer be straight so that the bending angle obtained over the length of the bending edge will vary. This should obviously be avoided. If the gripping platen 2 which constitutes the backing tool is adjustably mounted in the frame 1, as is the case with the upper gripping platen 2 in the apparatus of FIG. 1, the gripping platen 2 and the carrier 5 carrying that gripping platen 2 may be undesirably canted in the tracks 6. To ensure that the bending forces which are exerted by the drive means 11 cannot adversely affect the structure of the folding apparatus or the shape of the bent workpiece, the drive means 11 are not supported by the frame 1 but by the carrier 5 which carries the gripping platen 2 which constitutes the backing tool. For this purpose the carrier is provided with a plurality of angled brackets 13 and the drive means 11 for moving the bending tool 8 generally parallel to the plane of the gripped sheet metal element comprises a plurality of actuators 14, each of which comprises a hydraulic cylinder **14*a*, which is pivoted to one of said brackets 13, and a piston rod 14*b*, which is connected to the tool carrier 9, which carries the bending tool 8. Because the drive means 11 comprise a plurality of actuators 14, which are spaced along the bending tool 8 and are supported by respective brackets 13 carried by the carrier 5, the forces exerted on the bending tool and on the carrier 5 will be more evenly distributed so that the risk of a deflection of the upper gripping platen 2** will be reduced.

Those forces which are exerted by the drive means 11 during the bending operation and are effective between the upper gripping platen 2 and the brackets 13 will subject the gripping platen and the brackets 13 to bending loads. Owing to the short circuit of forces via the carrier 5, the less rigid structural part will tend to yield. But that yielding under the bending forces exerted cannot adversely affect the position of the gripping platen 2 relative to the frame 1 because the gripping platen 2 and the carrier 5 carrying it will be held in position by the tracks 6 of the frame 1 so that a deformation may result only in a displacement of the bracket 13. This will not affect the mounting of the gripping platen. As a result, the bending edge will remain straight even if deformations occur and this can be ensured without a need for a heavy, rigid structure. Any irregularities of the bending edge may only be due to an exertion of different bending forces; this can be taken into account by a proper selection of the actuating forces exerted by the actuators 14. If the actuators consist of hydraulic cylinders, the latter can be controlled in a particularly simple manner for that purpose.

If the sheet metal element 3 is not to be bent upwardly, as is shown in FIG. 1, but downwardly, the apparatus can be altered and provided with a bending tool which is appropriate for that operation. In that case the advantage afforded by the short circuit of forces transmitted by the carrier which carries the upper gripping platen 2 will be lost unless special measures are adopted. In accordance with FIGS. 2 to 4 this is accomplished in that a positive connection is established between the angled or curved brackets 13 of the carrier 5 which carries the upper gripping platen 2, on the one hand, and the carrier 4 carrying the lower gripping platen 2, on the other hand. That positive connection provides a short circuit of forces acting in the same direction via the lower gripping platen 2, which now serves as a backing tool, and the means for supporting the drive means 11. The positive connection will be established by simple means if each of the brackets 13 carries a backing member 15, which extends along the bending tool 8 and protrudes into longitudinally aligned recesses 16 of the frame and can be fixed in the recesses 16 by slidable wedges 17. These wedges 17 are connected to an actuating rod 18, which can be driven by the actuator 19 by which the wedges 17 can be advanced or retracted in unison by means of the actuating rod 18. In their retracted position, the wedges 17 permit the supporting member 15 to be adjusted to a position in which the brackets 13 can be deflected. This will not be possible when the wedges 17 have been advaneed to a locking position so that the reaction forces which are due to the operation of the drive means 11 will then be introduced into the frame 1 at the edges of the recesses 16. As the carrier 4 which carries the lower gripping platen 2 is immovably held in the frame 1, an appropriate short circuit of forces will be obtained.

The apparatus shown in FIGS. 5 and 6 comprises two bending tools 8*a* and 8*b*, which can be used to bend the gripped sheet metal element upwardly and downwardly without need for an alteration of the apparatus. The deformation of the gripping platen 2*a* or 2*b* which may alternatively serve as the backing tool is prevented in that the drive means 11*a* and 11*b* are properly supported against the carriers 4 and 5 which carry the gripping platens which serve as the backing tool in one case and the other. The several actuators 14 of the drive means 11*a* and 11*b* for moving the bending tools generally parallel to the plane of the gripped sheet metal element are supported by angled or curved brackets 13*a*, which are carried by the carrier 5 which carries the gripping platen 2*a* and by similar brackets 13*b*, which are carried by the carrier 4, which carries the gripping platen 2*b*. As a result, the bending tool 8*a* is included in a short circuit of forces transmitted by the gripping platen 2*a* and the carrier 5 with the brackets 13*a* and the bending tool 8*b* is included in a short circuit of forces transmitted by the carrier 4 which carries the gripping platen 2*b* and by the brackets 13*b*. As a result, the gripping platens 2*a* and 2*b* will not be deformed during an upward bending and a downward bending of the gripped sheet metal element. That result does not depend on the kind of the drive means used to move the bending tools 8*a* and 8*b* transversely to the plane of the gripped sheet metal element so that different designs and arrangements may be used for these drive means.

Such drive means has been disclosed, for example, in my U.S. Pat. No. 4,411,148 and is shown to comprise drives 12, each constituted by cylinder 20*a* linked respectively to brackets 13*a*, 13*b* and whose piston rod 20*b* engages shaft 22 by means of crank arm 21. The shaft operates adjustment lever 23 for moving bending tool 8*a* and 8*b*, respectively.

What is claimed is:

1. An apparatus for folding a sheet metal element, comprising a frame, first and second gripping platens adapted to grip between said gripping platens a sheet metal element extending in a plane, first and second carriers carried by said frame and spaced apart transversely to said plane and carrying said first and second gripping platens, respectively, at least one of said carriers and the gripping platen carried by it being movable relative to said frame transversely to said plane in one direction to grip said sheet metal element in said plane and in the opposite direction to release said sheet metal element, at least one bending tool mounted in said frame, a respective one of said gripping platens constituting a backing tool having a bending edge adjoining said plane, and said bending tool facing said bending edge and being movable relative to said frame in a first direction which is substantially parallel to said plane and in a second direction which is transverse to said plane and adapted to cooperate with said bending edge so that a sheet metal element gripped by said gripping platens in said plane and protruding from said bending edge toward said bending tool is bent around said bending edge, first drive means for moving said bending tool in said first direction and second drive means for moving said bending tool in said second direction, the improvement residing in that said second gripping plate constitutes a second backing tool having a second bending edge adjoining said plane and said bending tool is adapted to cooperate with said second bending edge so that a sheet metal element gripped by said gripping platens in said plane and protruding from said second bending edge toward said bending tool is bent around said second bending edge, said first drive means is supported by the carrier which carries said gripping platen which constitutes said backing tool, and selectively operable means is provided for positively connecting said first drive means to said second carrier when said bending tool is operated to bend said sheet metal element around said second bending edge.

2. The improvement set forth in claim 1, wherein said first carrier carries two brackets spaced along said first carrier, said first drive means comprise at least two actuators, each of which is connected to one of said brackets, and said selectively operable means are operable to positively connect said brackets to said second carrier.

3. The improvement set forth in claim 2, wherein said second carrier is immovably mounted in said frame, and said selectively operable means comprises a plurality of adjustable wedges, each of which is operable to positively connect one of said brackets to said frame.

* * * * *